US008600266B2

(12) United States Patent
Ishida et al.

(10) Patent No.: US 8,600,266 B2
(45) Date of Patent: Dec. 3, 2013

(54) DRIVE TRANSMISSION DEVICE AND IMAGE FORMING APPARATUS INCLUDING SAME

(75) Inventors: Masahiro Ishida, Kanagawa (JP); Yohei Miura, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 308 days.

(21) Appl. No.: 12/929,276

(22) Filed: Jan. 12, 2011

(65) Prior Publication Data

US 2011/0170892 A1 Jul. 14, 2011

(30) Foreign Application Priority Data

Jan. 13, 2010 (JP) ..... 2010-005338

(51) Int. Cl.
*G03G 15/00* (2006.01)

(52) U.S. Cl.
USPC ..... 399/167

(58) Field of Classification Search
USPC ..... 399/75, 167, 234, 36; 74/413
See application file for complete search history.

(56) References Cited

U.S. PATENT DOCUMENTS

| | | | |
|---|---|---|---|
| 5,768,656 | A | 6/1998 | Nagasue et al. |
| 6,949,896 | B2 | 9/2005 | Andoh et al. |
| 7,110,700 | B2 | 9/2006 | Andoh et al. |
| 7,242,883 | B2 | 7/2007 | Miura |
| 7,251,444 | B2 | 7/2007 | Matsuda et al. |
| 7,257,339 | B2 | 8/2007 | Yokoyama et al. |
| 7,330,009 | B2 | 2/2008 | Andoh et al. |
| 7,373,093 | B2 | 5/2008 | Shinohara et al. |
| 7,376,375 | B2 | 5/2008 | Kobayashi et al. |
| 7,386,262 | B2 | 6/2008 | Okamura et al. |
| 7,454,150 | B2 | 11/2008 | Matsuda et al. |
| 7,509,074 | B2 | 3/2009 | Yokoyama et al. |
| 7,702,252 | B2 | 4/2010 | Maehata et al. |
| 7,706,723 | B2 | 4/2010 | Ishida et al. |
| 7,748,695 | B2 | 7/2010 | Miura et al. |
| 7,800,335 | B2 | 9/2010 | Andoh et al. |

(Continued)

FOREIGN PATENT DOCUMENTS

| | | |
|---|---|---|
| JP | 9-185200 | 7/1997 |
| JP | 10-171331 A | 6/1998 |

(Continued)

OTHER PUBLICATIONS

English language abstract for patent publication No. JP-2000-347551 published Sep. 4, 2008 which corresponds to patent No. JP-4440372.

*Primary Examiner* — David Gray
*Assistant Examiner* — Sevan A Aydin
(74) *Attorney, Agent, or Firm* — Harness, Dickey & Pierce, P.L.C.

(57) ABSTRACT

A drive transmission device including at least one drive source, a drive transmission member, and a drive gear train. The drive transmission member includes an engaging part that engages a first rotary body provided within a unit detachably attachable to an image forming apparatus and a gear part that engages a motor gear attached to the at least one drive source. The engaging part and the gear part are formed together as an integrated unit. The drive gear train that transmits a driving force from the at least one drive source to a second rotary body provided within the unit includes a first gear and a second gear. The first gear engages the motor gear and the second gear is attached to the drive transmission member.

16 Claims, 6 Drawing Sheets

(56) References Cited

U.S. PATENT DOCUMENTS

| | | | | |
|---|---|---|---|---|
| 2003/0053823 | A1* | 3/2003 | Cho et al. | 399/167 |
| 2004/0037590 | A1* | 2/2004 | Morioka et al. | 399/167 |
| 2004/0156652 | A1 | 8/2004 | Chung et al. | |
| 2004/0164691 | A1 | 8/2004 | Andoh et al. | |
| 2005/0036797 | A1 | 2/2005 | Miura | |
| 2005/0053388 | A1 | 3/2005 | Yokoyama et al. | |
| 2005/0057209 | A1 | 3/2005 | Andoh et al. | |
| 2005/0085945 | A1 | 4/2005 | Andoh et al. | |
| 2005/0238372 | A1 | 10/2005 | Shinohara et al. | |
| 2005/0276634 | A1 | 12/2005 | Jeon | |
| 2006/0018681 | A1* | 1/2006 | Kim et al. | 399/167 |
| 2006/0110189 | A1 | 5/2006 | Matsuda et al. | |
| 2006/0133873 | A1 | 6/2006 | Andoh et al. | |
| 2006/0153604 | A1 | 7/2006 | Matsuda et al. | |
| 2006/0165442 | A1 | 7/2006 | Kobayashi et al. | |
| 2006/0182471 | A1 | 8/2006 | Okamura et al. | |
| 2007/0140715 | A1* | 6/2007 | Choi | 399/53 |
| 2007/0189815 | A1 | 8/2007 | Andoh et al. | |
| 2007/0231022 | A1 | 10/2007 | Yokoyama et al. | |
| 2008/0069635 | A1 | 3/2008 | Maehata et al. | |
| 2008/0089713 | A1 | 4/2008 | Ishida et al. | |
| 2008/0211176 | A1 | 9/2008 | Miura et al. | |
| 2009/0003877 | A1 | 1/2009 | Miura | |
| 2009/0017953 | A1 | 1/2009 | Uehara et al. | |
| 2009/0169225 | A1 | 7/2009 | Murata et al. | |
| 2009/0169259 | A1 | 7/2009 | Ebara et al. | |
| 2009/0263158 | A1 | 10/2009 | Murata et al. | |
| 2010/0239318 | A1 | 9/2010 | Maehata et al. | |
| 2010/0303509 | A1 | 12/2010 | Yamashita et al. | |

FOREIGN PATENT DOCUMENTS

| | | | |
|---|---|---|---|
| JP | 4440372 | B2 | 12/2000 |
| JP | 2001-147568 | A | 5/2001 |
| JP | 2003-295552 | A | 10/2003 |
| JP | 2007072236 | A | 3/2007 |
| JP | 2009-175667 | A | 8/2009 |

* cited by examiner

DRIVE TRANSMISSION DEVICE AND IMAGE FORMING APPARATUS INCLUDING SAME

PRIORITY STATEMENT

The present patent application claims priority from Japanese Patent Application No. 2010-005338, filed on Jan. 13, 2010, in the Japan Patent Office, which is hereby incorporated herein by reference in its entirety.

BACKGROUND

1. Field of the Invention

Illustrative embodiments described in this patent specification generally relate to a drive transmission device and an image forming apparatus including the drive transmission device.

2. Description of the Related Art

Related-art image forming apparatuses, such as copiers, printers, facsimile machines, and multifunction devices having two or more of copying, printing, and facsimile functions, typically form a toner image on a recording medium (e.g., a sheet of paper) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus by a sheet discharger.

The image forming apparatuses are often equipped with a detachably attachable process unit that contains multiple rotary bodies such as the photoconductor and a developing roller. The image forming apparatuses further include a drive transmission device that transmits a driving force from a drive source such as a motor to the photoconductor in the process unit. The drive transmission device is disposed within a housing of the image forming apparatus, and generally includes a motor gear attached to a shaft of the motor, a gear that engages the motor gear, and a coupling attached to a leading end of a rotary shaft to which the gear is fixed to engage an engaged part of the photoconductor.

However, with such a configuration, eccentric error upon attachment of the gear or the coupling to the rotary shaft may vary rotary speed of the photoconductor. In addition, in a case in which the driving force of the motor is transmitted to both of the photoconductor and the developing roller in the process unit via the gear, any load fluctuation on the developing roller is transmitted to the photoconductor. Consequently, the driving force is momentarily not transmitted from the motor gear to the gear due to backlash between the gear and the motor gear, possibly causing rotary speed of the photoconductor to fluctuate.

To counteract this problem, one known drive transmission device includes a photoconductor gear serving as a drive transmission member and having a gear part that engages a motor gear, a rotary shaft, and a coupling that engages an engaged part of a photoconductor. The gear part, the rotary shaft, and the coupling are formed together as an integrated unit, that is, the photoconductor gear, by pouring a resin into a mold using injection molding, thereby preventing eccentric error upon attachment of the gear part or the coupling to the rotary shaft. As a result, variation in rotary speed of the photoconductor can be prevented.

Further, in the above-described related-art drive transmission device, the motor gear fixed to a shaft of a motor engages both of the photoconductor gear and one of multiple gears that transmit a driving force from the motor to a developing roller. Accordingly, transmission of the driving force from the motor to the photoconductor is separated from transmission of the driving force from the motor to the developing roller. As a result, load fluctuation on the developing roller is transmitted to the motor gear through a gear train including the multiple gears that transmit the driving force to the developing roller. Because it is attached to the shaft of the motor and directly receives the driving force from the motor, the motor gear remains rotated by the driving force from the motor even when the load fluctuation in the developing roller is transmitted to the motor gear. Thus, the driving force is reliably transmitted to the photoconductor gear that engages the motor gear, thereby preventing variation in rotary speed of the photoconductor.

However, because the photoconductor gear and the multiple gears in the gear train are rotatably attached to a lateral plate of an image forming apparatus including the above-described drive transmission device, production costs of the lateral plate and installation cost are increased. Further, a size of the drive transmission device is increased, as described in detail below.

In order to reliably and evenly transmit the driving force of the motor to the photoconductor, it is important to accurately engage the photoconductor gear and the motor gear. Similarly, it is important to accurately engage the multiple gears in the gear train with one another in order to reliably and evenly transmit the driving force from the motor to the developing roller.

A mount on the lateral plate of the image forming apparatus to which the photoconductor gear is attached must be accurately formed to accurately attach the photoconductor gear to the mount, thereby enhancing accuracy in engagement of the photoconductor gear and the motor gear. In addition, multiple mounts on the lateral plate of the image forming apparatus to which the multiple gears in the gear train are respectively attached must be accurately formed to accurately attach the multiple gears to the respective mounts, thereby enhancing accuracy in engagement of the multiple gears. Further, a mount on the lateral plate of the image forming apparatus to which the motor is attached must be accurately formed to accurately attach the motor to the mount.

Therefore, in the above-described drive transmission device, higher production costs are needed for the lateral plate of the image forming apparatus to accurately form the mounts on the lateral plate. In addition, the photoconductor gear, the multiple gears in the gear train, and the motor must be accurately attached to the lateral plate, causing an increase in installation costs.

Further, because the multiple gears in the gear train are attached to the lateral plate of the image forming apparatus, it is necessary to dispose the gear train around the gear part of the photoconductor gear, thereby increasing the size of the drive transmission device.

SUMMARY

In view of the foregoing, illustrative embodiments described herein provide a drive transmission device that prevents variation in rotary speed of a rotary body to which a drive transmission member transmits a driving force. The drive transmission device reliably and evenly transmits the driving force to the rotary body, and prevents an increase in production costs, installation costs, and size of the device. Illustrative embodiments described herein also provide an image forming apparatus including the drive transmission device.

At least one embodiment provides a drive transmission device including at least one drive source, a drive transmission member, and a drive gear train. The drive transmission member includes an engaging part that engages a first rotary body provided within a unit detachably attachable to an image forming apparatus and a gear part that engages a motor gear attached to the at least one drive source. The engaging part and the gear part are formed together as an integrated unit. The drive gear train that transmits a driving force from the at least one drive source to a second rotary body provided within the unit includes a first gear and a second gear. The first gear engages the motor gear and the second gear is attached to the drive transmission member.

At least one embodiment provides an image forming apparatus including a unit having first and second rotary bodies and detachably attachable to the image forming apparatus and the drive transmission device described above.

Additional features and advantages of the illustrative embodiments will be more fully apparent from the following detailed description, the accompanying drawings, and the associated claims.

BRIEF DESCRIPTION OF THE DRAWINGS

A more complete appreciation of the illustrative embodiments described herein and the many attendant advantages thereof will be readily obtained as the same becomes better understood by reference to the following detailed description when considered in connection with the accompanying drawings, wherein.

Figure 1:
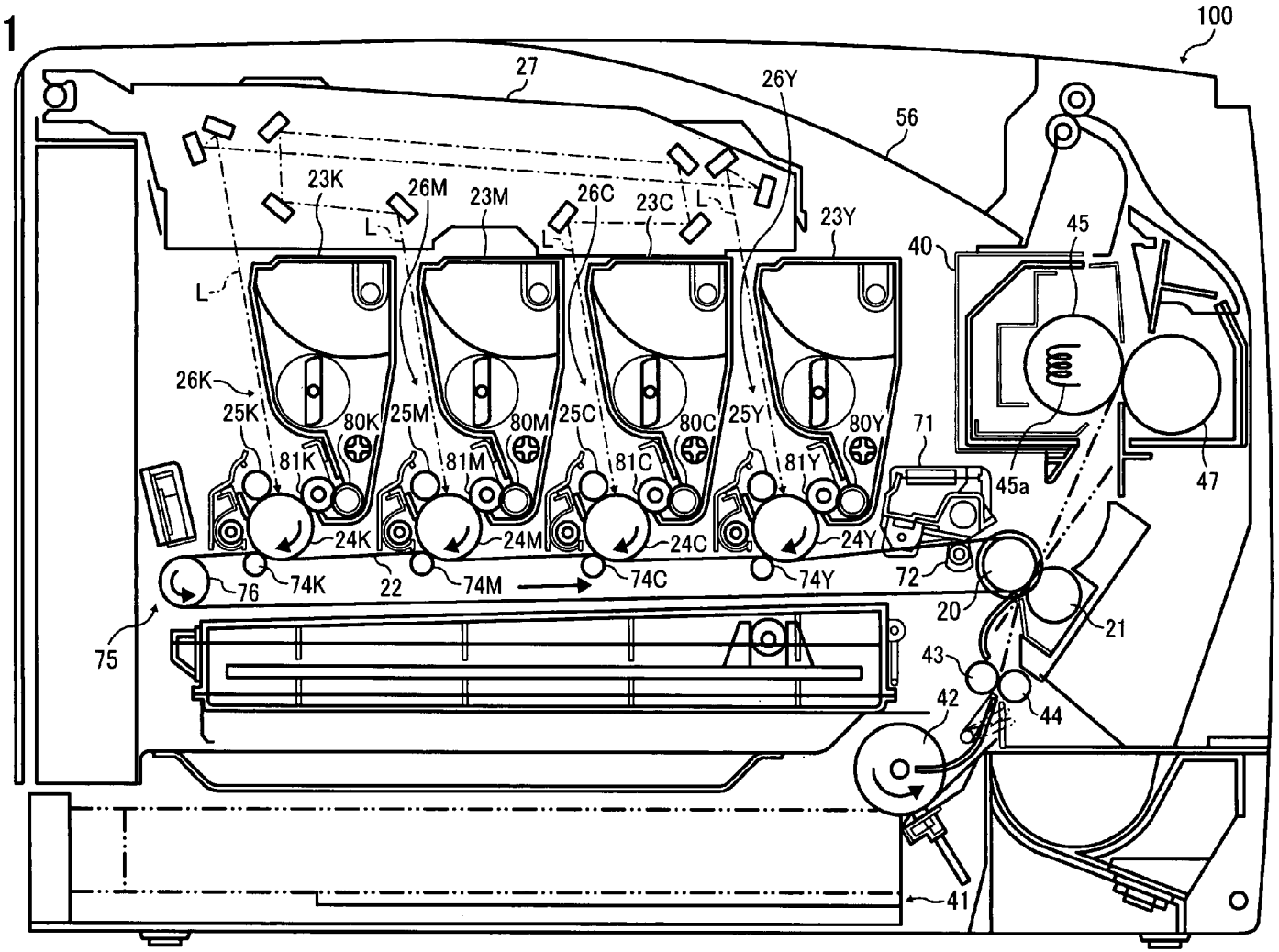
FIG. 1 is a vertical cross-sectional view illustrating an example of a configuration of an image forming apparatus according to illustrative embodiments.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

A description is now given of illustrative embodiments of the present invention with reference to drawings, wherein like reference numerals designate identical or corresponding parts throughout the several views.

Figure 2:
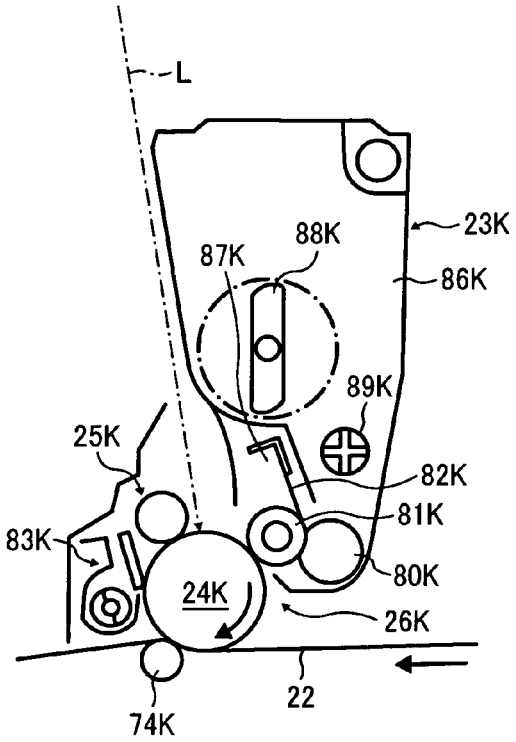
FIG. 2 is a vertical cross-sectional view illustrating an example of a configuration of a process unit included in the image forming apparatus illustrated in FIG. 1.

FIG. 1 is a vertical cross-sectional view illustrating an example of a configuration of a printer employing an electrophotographic system serving as an image forming apparatus 100 according to illustrative embodiments. The image forming apparatus 100 includes four process units 26Y, 26C, 26M, and 26K (hereinafter collectively referred to as process units 26) each forming a toner image of a specific color, that is, yellow (Y), cyan (C), magenta (M), or black (K). Each of the process units 26 has the same basic configuration, differing only in the color of toner used, and is replaced with a new process unit at the end of its product life. Referring to the process unit 26K that forms black toner images as a representative example, a drum-type photoconductor 24K serving as a latent image carrier, a cleaning device 83K, a neutralizing device, a charger 25K, a developing device 23K, and so forth are provided therein as illustrated in FIG. 2. FIG. 2 is a vertical cross-sectional view illustrating an example of a configuration of the process unit 26K. The process unit 26K is detachably attachable to the image forming apparatus 100 so that consumable components can be replaced with new components all at once.

The charger 25K evenly charges a surface of the photoconductor 24K rotated by drive means in a clockwise direction in FIG. 2. The charged surface of the photoconductor 24K is scanned with laser light L to form an electrostatic latent image of black thereon. The electrostatic latent image thus formed is developed with black toner by the developing device 23K so that a black toner image is formed on the surface of the photoconductor 24K. The black toner image thus formed is then primarily transferred onto an intermediate transfer belt 22 described in detail later. The cleaning device 83K removes residual toner from the surface of the photoconductor 24K after primary transfer of the black toner image onto the intermediate transfer belt 22. Thereafter, the neutralizing device removes residual electric charges from the surface of the photoconductor 24K so that the surface of the photoconductor 24K is initialized to be ready for the next sequence of image formation. It is to be noted that a cylindrical drum portion of the photoconductor 24K is mainly composed of a hollow aluminum pipe coated with an organic photoconductive layer. A flange having a drum shaft is attached to both ends of the drum portion of the photoconductor 24K in a direction of a rotary shaft of the photoconductor 24K.

Toner images of yellow, cyan, and magenta are also formed on surfaces of photoconductors 24Y, 24C, and 24M in the process units 26Y, 26C, and 26M, respectively, in a similar manner as the process unit 26K. The toner images of the respective colors thus formed are also primarily transferred onto the intermediate transfer belt 22.

The developing device 23K includes a vertically long hopper 86K that stores black toner and a developing part 87K. The hopper 86K includes an agitator 88K rotatively driven by drive means, an agitation paddle 89K rotatively driven by drive means and provided below the agitator 88K, a toner supply roller 80K rotatively driven by drive means and provided below the agitation paddle 89K, and so forth. The black toner stored within the hopper 86K is moved to the toner supply roller 80K by its own weight while agitated by rotation of the agitator 88K and the agitation paddle 89K. The toner supply roller 80K has a metal core and a roller formed of a resin foam and so forth that covers a surface of the metal core. The black toner adheres to a surface of the toner supply roller 80K rotated by the drive means.

The developing part 87K of the developing device 23K includes a developing roller 81K rotated while contacting both of the photoconductor 24K and the toner supply roller 80K, a blade 82K a leading end of which contacts a surface of the developing roller 81K, and so forth. The black toner adhering to the toner supply roller 80K in the hopper 86K is supplied to the surface of the developing roller 81K at a portion where the developing roller 81K contacts the toner supply roller 80K. A thickness of the black toner thus supplied to the developing roller 81K is restricted by the blade 82K when the black toner passes through a portion where the developing roller 81K and the blade 82K contact each other as the developing roller 81K rotates. Thereafter, the black toner is attached to the electrostatic latent image of black formed on the surface of the photoconductor 24K at a developing range where the developing roller 81K and the photoconductor 24K contact each other. As a result, the electrostatic latent image is developed with the black toner to form a black toner image on the surface of the photoconductor 24K.

The toner images of yellow, cyan, and magenta are also formed on the surfaces of the photoconductors 24Y, 24C, and 24M in the process units 26Y, 26C, and 26M, respectively, in a similar manner as the process unit 26K described above.

An optical writing unit 27 serving as a latent image writing unit is provided above the process units 26. The optical writing unit 27 scans each of the surfaces of the photoconductors 24Y, 24C, 24M, and 24K (hereinafter collectively referred to as photoconductors 24) with the laser light L emitted from a laser diode based on image data. Accordingly, electric latent images of yellow, cyan, magenta, and black are formed on the surfaces of the photoconductors 24, respectively. The optical writing unit 27 and the process units 26 together serve as an image forming unit that forms visible images of different colors, that is, the toner images of yellow, cyan, magenta, or black, on at least three latent image carriers, respectively.

The optical writing unit 27 directs the laser light L emitted from a light source, that is, the laser diode, onto the surfaces of the photoconductors 24 through multiple optical lenses and mirrors while deflecting the laser light L in a main scanning direction using a polygon mirror rotatively driven by a polygon motor. Alternatively, LED light emitted from multiple light-emitting diodes (LEDs) in an LED array may be directed onto the surfaces of the photoconductors 24 to form the electrostatic latent images of the respective colors.

A transfer unit 75 that moves the seamless intermediate transfer belt 22 in a counterclockwise direction in FIG. 1 is provided below the process units 26. The transfer unit 75 includes the intermediate transfer belt 22, a drive roller 76, a tension roller 20, four primary transfer rollers 74Y, 74C, 74M, and 74K (hereinafter collectively referred to as primary transfer rollers 74), a secondary transfer roller 21, a belt cleaning device 71, a cleaning back-up roller 72, and so forth.

The intermediate transfer belt 22 is wound around the drive roller 76, the tension roller 20, the cleaning back-up roller 72, and the four primary transfer rollers 74 each disposed inside a loop formed by the intermediate transfer belt 22. The intermediate transfer belt 22 is seamlessly rotated in the counterclockwise direction in FIG. 1 by a rotary force of the drive roller 76 rotatively driven by drive means in the counterclockwise direction.

The primary transfer rollers 74 are provided opposite the photoconductors 24 with the intermediate transfer belt 22 interposed therebetween. As a result, primary transfer nips are formed between a surface of the intermediate transfer belt 22 and the photoconductors 24, respectively.

A primary transfer bias is applied to each of the primary transfer rollers 74 from a transfer bias source. Accordingly, a primary transfer electric field is formed between the electrostatic latent images formed on the photoconductors 24 and the primary transfer rollers 74, respectively. It is to be noted that, alternatively, a transfer charger or a transfer brush may be used in place of the primary transfer rollers 74.

The yellow toner image formed on the surface of the photoconductor 24Y is primarily transferred onto the intermediate transfer belt 22 by the primary transfer electric field and a pressure at the primary transfer nip when entering the primary transfer nip by rotation of the photoconductor 24Y. The intermediate transfer belt 22 having the yellow toner image thereon is further rotated, and the toner images of cyan, magenta, and black respectively formed on the surfaces of the photoconductors 24C, 24M, and 24K are primarily transferred onto the intermediate transfer belt 22 when passing through the respective primary transfer nips. Accordingly, the toner images of cyan, magenta, and black are sequentially superimposed one atop the other on the yellow toner image so that a full-color toner image is formed on the intermediate transfer belt 22.

The secondary transfer roller 21 is provided outside the loop formed by the intermediate transfer belt 22 and opposite the tension roller 20 with the intermediate transfer belt 22 interposed therebetween. Accordingly, a secondary transfer nip is formed at a portion where the surface of the intermediate transfer belt 22 and the secondary transfer roller 21 contact each other. A secondary transfer bias is applied to the secondary transfer roller 21 from a transfer bias source. As a result, a secondary transfer electric field is formed between the secondary transfer roller 21 and the tension roller 20 connected to the ground.

A sheet feed cassette 41 that stores a stack of multiple sheets and is detachably attachable to a housing of the image forming apparatus 100 is provided below the transfer unit 75. A sheet feed roller 42 contacting a sheet placed at the top of the stack of multiple sheets (hereinafter referred to as a top sheet) is rotated in the counterclockwise direction in FIG. 1 at a predetermined timing to feed the top sheet to a sheet feed path.

A pair of registration rollers 43 and 44 is provided near the end of the sheet feed path. Rotation of the pair of registration rollers 43 and 44 is stopped immediately after the pair of registration rollers 43 and 44 sandwiches the sheet fed from the sheet feed cassette 41. Thereafter, rotation of the pair of registration rollers 43 and 44 is resumed at a timing such that the sheet is conveyed to the secondary transfer nip in synchronization with the full-color toner image formed on the intermediate transfer belt 22.

The full-color toner image is secondarily transferred onto the sheet from the intermediate transfer belt 22 at the secondary transfer nip by the secondary transfer electric field and a pressure at the secondary transfer nip so that the full-color toner image is formed on the sheet. After passing through the secondary transfer nip, the sheet having the full-color toner image thereon is separated from the secondary transfer roller 21 and the intermediate transfer belt 22 by curvature, and is further conveyed to a fixing device 40 through a post-transfer conveyance path.

The belt cleaning device 71 contacting the surface of the intermediate transfer belt 22 removes residual toner from the surface of the intermediate transfer belt 22 after secondary transfer of the full-color toner image onto the sheet. The cleaning back-up roller 72 provided inside the loop formed by the intermediate transfer belt 22 assists the belt cleaning device 71 to clean the intermediate transfer belt 22.

The fixing device 40 includes a fixing roller 45 having a heat source 45a such as a halogen lamp, and a pressing roller 47 rotating while contacting the fixing roller 45 at a predetermined amount of pressure. A fixing nip is formed between the fixing roller 45 and the pressing roller 47. The sheet conveyed to the fixing device 40 is sandwiched by the fixing roller 45 and the pressing roller 47 at the fixing nip such that a side of the sheet onto which the unfixed full-color toner image is transferred closely contacts the fixing roller 45. Accordingly, the toner of the full-color toner image is softened by heat and pressure applied from the fixing roller 45 and the pressing roller 47 so that the full-color toner image is fixed onto the sheet. As a result, a full-color image is formed on the sheet.

When a simplex print mode is set by input from an operation unit such as a numeric keypad or a control signal sent from a personal computer or the like, the sheet conveyed from the fixing device 40 is discharged from the image forming apparatus 100 and is stacked on a stack part 56 provided on an upper cover of the image forming apparatus 100.

A description is now given of a drive transmission device that transmits a driving force from a motor serving as a drive source to the photoconductors 24 and developing rollers 81Y, 81C, 81M, and 81K (hereinafter collectively referred to as developing rollers 81). It is to be noted that the configuration and operation of the developing rollers 81Y, 81C, and 81M are the same as the developing roller 81K, differing only in the color of toner used.

The image forming apparatus 100 further includes a first drive transmission device 1K that transmits a driving force to the photoconductor 24K and the developing roller 81K in the process unit 26K and a second drive transmission device 1YCM that transmits a driving force to the photoconductors 24Y, 24C, and 24M and the developing rollers 81Y, 81C, and 81M in the process units 26Y, 26C, and 26M.

Figure 3:
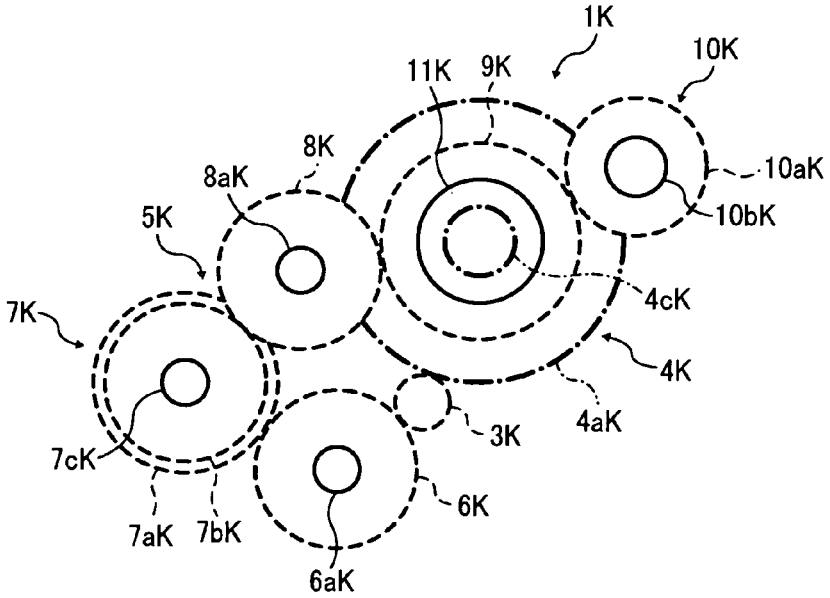
FIG. 3 is a front view illustrating an example of a configuration of a first drive transmission device according to illustrative embodiment.
Figure 4:
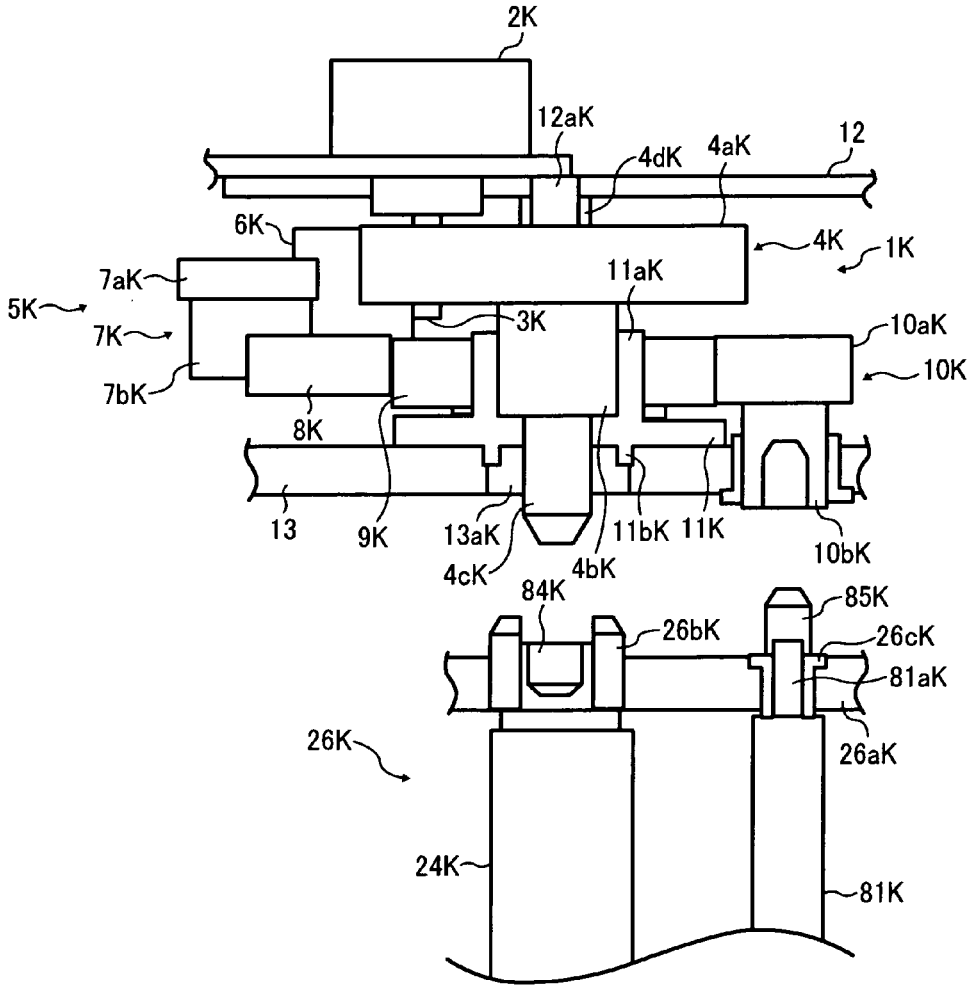
FIG. 4 is a schematic view illustrating a configuration of the first drive transmission device and surrounding components.

FIG. 3 is a front view illustrating an example of a configuration of the first drive transmission device 1K. FIG. 4 is a schematic view illustrating a configuration of the first drive transmission device 1K and surrounding components. It is to be noted that rotary shafts of gears in a drive gear train 5K are omitted in FIG. 4 for ease of illustration.

The first drive transmission device 1K is provided between a lateral plate 13 and a support plate 12 of the image forming apparatus 100. The first drive transmission device 1K includes a photoconductor gear 4K serving as a drive transmission member that transmits a driving force from a drive source, that is, a drive motor 2K, to the photoconductor 24K and the drive gear train 5K that transmits the driving force from the drive motor 2K to the developing roller 81K. The drive gear train 5K includes a first relay gear 6K, a clutch 7K, a second relay gear 8K, an idler gear 9K, a developing gear 10K, and so forth. The drive gear train 5K is accommodated within a length of the photoconductor gear 4K in a direction of a shaft of the photoconductor gear 4K to reduce a length of the first drive transmission device 1K in that direction.

The drive motor 2K is attached to a back surface of the support plate 12. A rotary shaft of the drive motor 2K is inserted into a hole formed on the support plate 12 from the back surface of the support plate 12 so that a leading end of the rotary shaft of the drive motor 2K is positioned between the support plate 12 and the lateral plate 13 while the drive motor 2K itself is disposed outside the support plate 12. A motor gear 3K is fixed to the leading end of the rotary shaft of the drive motor 2K.

The photoconductor gear 4K is provided above the rotary shaft of the drive motor 2K. The photoconductor gear 4K includes a disk-shaped gear part 4aK, a shaft 4bK, and a convex coupling 4cK serving as an engaging part. The gear part 4aK, the shaft 4bK, and the coupling 4cK are formed together as an integrated unit, that is, the photoconductor gear 4K, of the same material such as a resin material. Accordingly, any eccentric error upon attachment of the gear part 4aK and the coupling 4cK to the shaft 4bK can be prevented, thereby preventing variation in rotary speed of the photoconductor 24K caused by the eccentric error.

A holding member 11K that holds the photoconductor gear 4K and the idler gear 9K is attached to the lateral plate 13. For example, the holding member 11K is formed of a resin material having a reduced friction coefficient, such as a polyacetal resin. The holding member 11K has a cylinder 11aK. A leading end of the coupling 4cK of the photoconductor gear 4K is inserted into a positioning hole 13aK formed on the lateral plate 13 such that the photoconductor gear 4K is rotatably held on an inner circumferential surface of the cylinder 11aK. An engagement hole 4dK is formed at a rotary center on a lateral surface of the photoconductor gear 4K on the support plate 12 side. The engagement hole 4dK engages a shaft 12aK provided to the support plate 12 such that the support plate 12 supports the photoconductor gear 4K.

A diameter of the gear part 4aK of the photoconductor gear 4K is larger than that of the photoconductor 24K, and the gear part 4aK engages the motor gear 3K. The large diameter of the gear part 4aK can reduce a pitch error on the surface of the photoconductor 24K corresponding to engagement of teeth of the gear part 4aK and those of the motor gear 3K one by one, thereby preventing uneven print density or banding in a sub-scanning direction. In addition, a deceleration step from the motor gear 3K to the photoconductor 24K is set to one in order to reduce number of components and production costs as well as transmission error caused by an engagement error or an eccentric error. A speed reduction ratio is determined by a relation between a target speed of the photoconductor 24K and characteristics of the drive motor 2K based on a speed range that provides higher efficiency and higher rotation accuracy. Further, the coupling 4cK has a spline shaft in which teeth are formed at an outer circumference of the shaft. The photoconductor gear 4K is formed of a resin material having a reduced friction coefficient, such as a polyacetal resin.

The first relay gear 6K fixed to a rotary shaft 6aK rotatably supported on the support plate 12 is disposed below the rotary shaft of the drive motor 2K and engages the motor gear 3K. The clutch 7K includes an input gear 7aK that engages the first relay gear 6K, an output gear 7bK that engages the second relay gear 8K, and a clutch shaft 7cK rotatably supported on the support plate 12. The clutch 7K is controlled by a control unit to be engaged or disengaged to transmit a rotary driving force of the input gear 7aK to the clutch shaft 7cK or to idly rotate the input gear 7aK. Specifically, when power is supplied to the clutch 7K, the rotary driving force of the input gear 7aK is transmitted to the clutch shaft 7cK to rotate the output gear 7bK. By contrast, in a case in which power is not supplied to the clutch 7K, the input gear 7aK is idly rotated on the clutch shaft 7cK even when the drive motor 2K is rotated, thereby stopping rotation of the output gear 7bK.

The second relay gear 8K is fixed to a rotary shaft 8aK rotatably supported on the support plate 12 and engages the idler gear 9K and the output gear 7bK. The idler gear 9K is rotatably held on an outer circumferential surface of the cylinder 11aK of the holding member 11K. The developing gear 10K includes a gear part 10aK that engages the idler gear 9K and a concave cylindrical coupling 10bK. An outer circumferential surface of the coupling 10bK rotatably engages a bearing provided to the lateral plate 13 so that the developing gear 10K is rotatably supported on the lateral plate 13.

The flange provided to the photoconductor 24K on the lateral plate 13 side has a concave cylindrical coupling 84K, and internal teeth are formed on an inner circumferential surface of the coupling 84K. A bearing 26bK provided to a casing 26aK of the process unit 26K engages an outer circumferential surface of the coupling 84K, and a part of the bearing 26bK protrudes from the casing 26aK. A rotary shaft 81aK of the developing roller 81K is rotatably supported by a bearing 26cK provided to the casing 26aK, and a leading end of the rotary shaft 81aK protrudes from the casing 26aK. A spline shaft 85K serving as a convex coupling is provided at the leading end of the rotary shaft 81aK on the lateral plate 13 side.

The convexity of the coupling 4cK of the photoconductor gear 4K and the concavity of the coupling 84K provided to the photoconductor 24K bring the following advantages compared to a configuration in which the shapes of these components are reversed. If the coupling 4cK is concave and the coupling 84K is convex, the coupling 84K protrudes from the casing 26aK of the process unit 26K, and consequently, the coupling 84K engages the coupling 4cK at the outside of the casing 26aK. By contrast, according to illustrative embodiments described herein the convex coupling 4cK of the photoconductor gear 4K engages the concave coupling 84K at the inside of the casing 26aK. As a result, a position where the coupling 4cK and the coupling 84K engage each other is closer to the photoconductor 24K, thereby preventing fluctuation of the photoconductor 24K.

As described above, the coupling 84K provided to the photoconductor 24K is formed on the flange and the outer circumferential surface thereof is supported on the casing 26aK by the bearing 26bK. Accordingly, provision of a shaft that passes through the photoconductor 24K can be eliminated, thereby reducing component costs and installation costs. Ultimately, production costs for the process unit 26K can be reduced.

The coupling 10bK of the developing gear 10K is concave and the coupling 85K provided on the developing roller 81K side is convex as described above. Because variation in rotary speed of the developing roller 81K is not as critical as that of the photoconductor 24K, a concave coupling that requires higher costs to form inner teeth, that is, the developing gear 10bK, is provided on the image forming apparatus 100 side, thereby reducing production costs for the process unit 26K.

Upon attachment of the process unit 26K to the body of the image forming apparatus 100, a part of the bearing 26bK protruding from the casing 26aK is fitted into the positioning hole 13aK of the lateral plate 13. Accordingly, the process unit 26K is securely positioned in the image forming apparatus 100. At this time, the inner teeth of the coupling 84K provided to the flange engage teeth of the convex coupling 4cK of the photoconductor gear 4K. In addition, teeth of the spline shaft 85K provided to the rotary shaft 81aK of the developing roller 81K engage the inner teeth of the concave coupling 10bK of the developing gear 10K.

The driving force of the drive motor 2K is transmitted to the photoconductor 24K through the motor gear 3K and the photoconductor gear 4K while transmitted to the developing roller 81K through the motor gear 3, the first relay gear 6K, the clutch 7K, the second relay gear 8K, the idler gear 9K, and the developing gear 10K. At this time, the shaft 4bK of the photoconductor gear 4K slides against the inner circumferential surface of the cylinder 11aK of the holding member 11K. However, because both of the photoconductor gear 4K and the holding member 11K are formed of a resin material having a reduced friction coefficient, such as a polyacetal resin as described above, abrasion of the shaft 4bK of the photoconductor gear 4K and the inner circumferential surface of the cylinder 11aK of the holding member 11K can be prevented. In addition, although the idler gear 9K slides against the outer circumferential surface of the cylinder 11aK of the holding member 11K, the idler gear 9K also formed of a resin material having a reduced friction coefficient can prevent abrasion of the idler gear 9K and the cylinder 11aK. Alternatively, a ball bearing may be provided between the photoconductor gear 4K and the inner circumferential surface of the cylinder 11aK of the holding member 11K, on the one hand, and the idler gear 9K and the outer circumferential surface of the cylinder 11aK of the holding member 11K, on the other, such that the photoconductor gear 4K and the idler gear 9K are rotatably held on the holding member 11K by the ball bearings, respectively.

In the first drive transmission device 1K, the idler gear 9K is coaxially attached to the photoconductor gear 4K via the holding member 11K, thereby simplifying the configuration. In order to attach the photoconductor gear 4K to the image forming apparatus 100, first, the coupling 4bK of the photoconductor gear 4K is inserted into the cylinder 11aK of the holding member 11K to engage the shaft 4bK of the photoconductor gear 4K with the cylinder 11aK of the holding member 11K. Next, the idler gear 9K is engaged with the outer circumferential surface of the holding member 11K, and a protrusion 11bK provided to the holding member 11K is fitted into the positioning hole 13aK provided on the lateral plate 13 to position the holding member 11K on the lateral plate 13. Accordingly, the photoconductor gear 4K held on the holding member 11K and the idler gear 9K coaxially attached to the photoconductor gear 4aK via the holding member 11K are positioned at a predetermined position on the lateral plate 13. Thereafter, the shaft 12aK provided to the support plate 12 is inserted into the engagement hole 4dK to install the photoconductor gear 4K in the image forming apparatus 100. At the same time, the idler gear 9K coaxially attached to the photoconductor gear 4K is installed in the image forming apparatus 100. Because the photoconductor gear 4K positioned on the lateral plate 13 is installed in the image forming apparatus 100, the idler gear 9K coaxially attached to photoconductor gear 4aK is also positioned on the lateral plate 13 and is installed in the image forming apparatus 100. As a result, installation costs can be reduced compared to a case in which the photoconductor gear 4K and the idler gear 9K are individually positioned on the lateral plate 13 and installed in the image forming apparatus 100. In addition, processing for installing the idler gear 9K on the lateral plate 13 is not needed, thereby further reducing production costs. Further, the first drive transmission device 1K can be made more compact compared to a case in which the idler gear 9K is attached to the lateral plate 13, thereby making the image forming apparatus 100 more compact.

Figure 5:
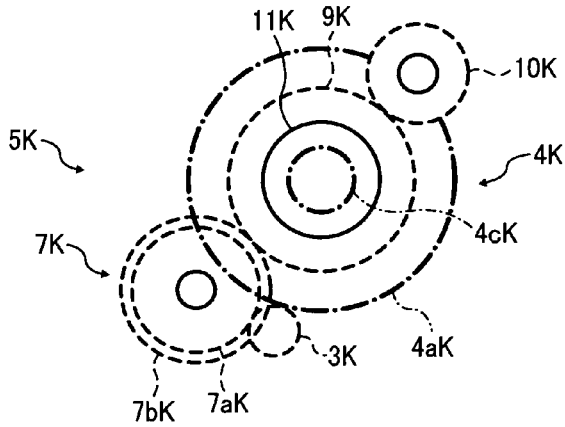
FIG. 5 is a front view illustrating another example of the configuration of the first drive transmission device.

Although the clutch 7K is disposed not to overlap the photoconductor gear 4K in order to achieve easy replacement of the clutch 7K in the first drive transmission device 1K illustrated in FIGS. 3 and 4, alternatively, for example, the drive gear train 5K may be formed by the clutch 7K, the idler gear 9K, and the developing gear 10K such that a part of the clutch 7K overlaps a part of the gear part 4aK of the photoconductor gear 4K as illustrated in FIG. 5. In the example illustrated in FIG. 5, the input gear 7aK of the clutch 7K engages the motor gear 3K, and the idler gear 9K coaxially attached to the photoconductor gear 4K via the holding member 11K engages the output gear 7bK of the clutch 7K and the developing gear 10K. This configuration can make the first drive transmission device 1K more compact, thereby making the image forming apparatus 100 more compact. It should be noted that although the clutch 7K is provided to extend the product life of the developing roller 81K, alternatively a relay gear may be provided in place of the clutch 7K.

It is preferable that the idler gear 9K and the developing gear 10K that engages the idler gear 9K be provided at positions closer to the process unit 26K than the gear part 4aK of the photoconductor gear 4K. Accordingly, the gear part 4aK can have a larger diameter without being obstructed by the coupling 10bK of the developing gear 10K. As a result, the diameter of the gear part 4aK can be extended such that a part of the gear part 4aK of the photoconductor gear 4K overlaps the rotary shaft 81aK of the developing roller 81K.

Each of the photoconductor gear 4K and the first relay gear 6K engages the motor gear 3K such that the driving force is transmitted from the drive motor 2K separately to the photoconductor 24K and the developing roller 81K. As a result, a load on the developing roller 81K does not affect rotation of the photoconductor 24K, thereby preventing variation in rotary speed of the photoconductor 24K.

Figure 6:
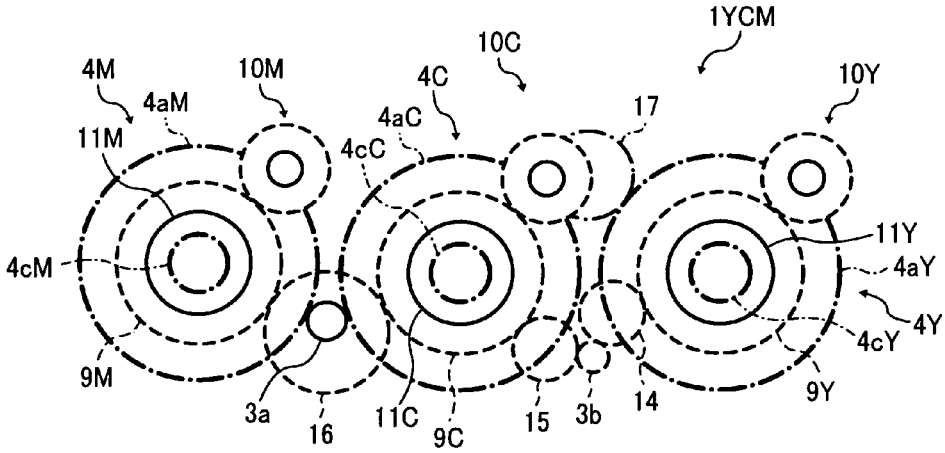
FIG. 6 is a front view illustrating an example of a configuration of a second drive transmission device according to illustrative embodiments.
Figure 7:
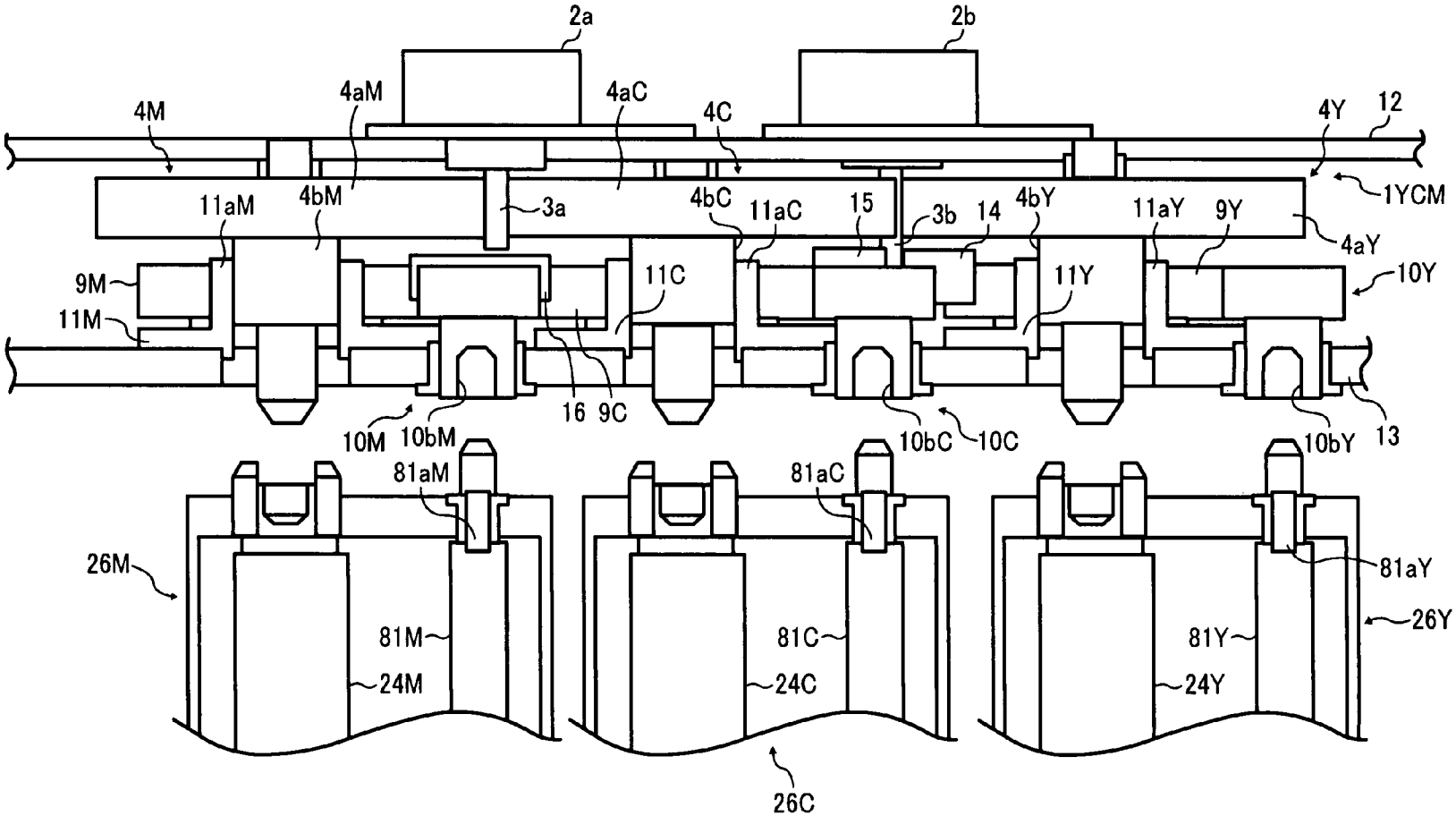
FIG. 7 is a schematic view illustrating a configuration of the second drive transmission device and surrounding components.
Figure 8:
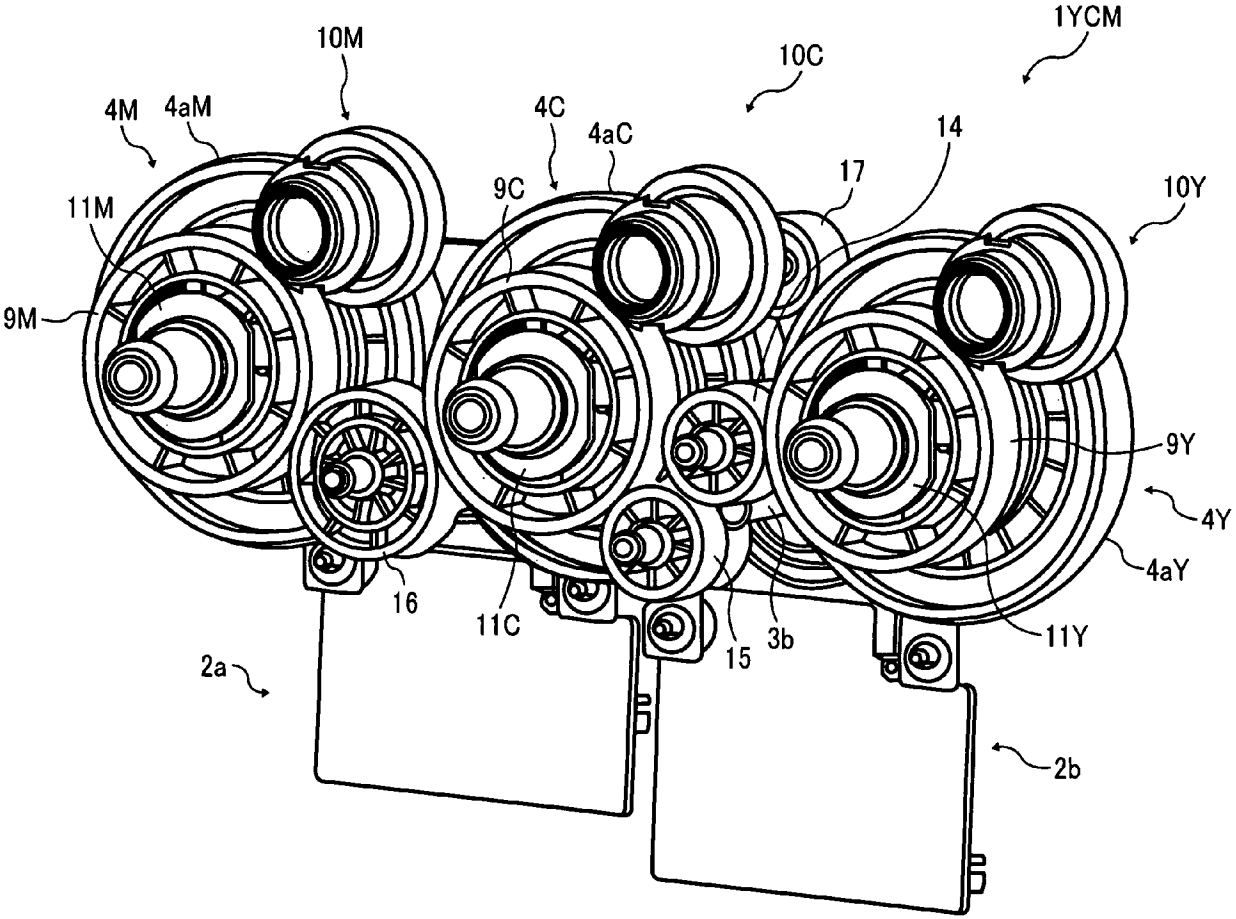
FIG. 8 is a perspective view illustrating the configuration of the second drive transmission device.

A description is now given of the second drive transmission device 1YCM according to illustrative embodiments with reference to FIGS. 6 to 8. FIG. 6 is a front view illustrating an example of a configuration of the second drive transmission device 1YCM. FIG. 7 is a schematic view illustrating a configuration of the second drive transmission device 1YCM and surrounding components. FIG. 8 is a perspective view illustrating the configuration of the second drive transmission device 1YCM. It is to be noted that only the differences from the configuration of the first drive transmission device 1K are described in detail below.

The second drive transmission device 1YCM is disposed between the lateral plate 13 and the support plate 12, and includes a first drive gear train that transmits a driving force from a first drive motor 2*a* serving as a drive source to each of the photoconductors 24Y, 24C, and 24M and a second drive gear train that transmits a driving force from a second drive motor 2*b* serving as a drive source to each of the developing rollers 81Y, 81C, and 81M.

The first drive gear train includes photoconductor gears 4Y, 4C, and 4M and an idler gear 17. Each of the photoconductor gears 4Y, 4C, and 4M has the same configuration as the photoconductor gear 4K, and is rotatably held on an inner circumferential surface of each of cylinders 11aY, 11aC, and 11aM of holding members 11Y, 11C, and 11M attached to the lateral plate 13 in a similar manner as the photoconductor gear 4K. Each of a gear part 4aM of the photoconductor gear 4M and a gear part 4aC of the photoconductor gear 4C engages a first motor gear 3*a* fixed to a rotary shaft of the first drive motor 2a. The idler gear 17 is disposed between the photoconductor gears 4Y and 4C and engages each of a gear part 4aY of the photoconductor gear 4Y and the gear part 4aC of the photoconductor gear 4C.

The driving force of the first drive motor 2*a* is transmitted to the photoconductor 24M through the first motor gear 3*a* and the photoconductor gear 4M. The driving force of the first drive motor 2*a* is,also transmitted to the photoconductor 24C through the first motor gear 3*a* and the photoconductor gear 4C. In addition, the driving force of the first drive motor 2*a* is further transmitted from the motor gear 3*a* to the photoconductor 24Y through the photoconductor gear 4C, the idler gear 17, and the photoconductor gear 4Y.

In the second drive gear train, each of first and second relay gears 14 and 15 engages a second motor gear 3*b* fixed to a rotary shaft of the second drive motor 2*b*. The first relay gear 14 further engages an idler gear 9Y. In a similar manner as the idler gear 9K, the idler gear 9Y is rotatably held on an outer circumferential surface of the cylinder 11aY of the holding member 11Y, and engages a developing gear 10Y.

An idler gear 9C engages the second relay gear 15 and is rotatably held on an outer circumferential surface of the cylinder 11aC of the holding member 11C. The idler gear 9C further engages each of a developing gear 10C and a third relay gear 16. The third relay gear 16 also engages an idler gear 9M rotatably held on an outer circumferential surface of the cylinder 11aM of the holding member 11M. The idler gear 9M further engages a developing gear 10M. Each of the developing gears 10Y, 10C, and 10M has the same configuration as the developing gear 10K.

The driving force of the second drive motor 2*b* is transmitted to the developing roller 81Y through the second motor gear 3*b*, the first relay gear 14, the idler gear 9Y, and the developing gear 10Y. The driving force of the second motor gear 3*b* is also transmitted to the developing roller 81C through the second motor gear 3*b*, the second relay gear 15, the idler gear 9C, and the developing gear 10C on the one hand, and to the developing roller 81M through the second motor gear 3*b*, the second relay gear 15, the idler gear 9C, the third relay gear 16, the idler gear 9M, and the developing gear 10M.

The idler gears 9Y, 9C, and 9M are coaxially attached to the photoconductor gears 4Y, 4C, and 4M via the holding member 11Y, 11C, and 11M, respectively, in a similar manner as the idler gear 9K. Accordingly, the photoconductor gears 4Y, 4C, and 4M positioned on the lateral plate 13 are installed in the image forming apparatus 100, and the idler gears 9Y, 9C, and 9M positioned on the lateral plate 13 through the photoconductor gears 4Y, 4C, and 4M are simultaneously installed in the image forming apparatus 100. As a result, installation costs can be reduced compared to a case in which the photoconductor gears 4Y, 4C, and 4M and the idler gears 9Y, 9C, and 9M are individually positioned on the lateral plate 13 and are then installed separately in the image forming apparatus 100. In addition, processing for installing the idler gears 9Y, 9C, and 9M on the lateral plate 13 is not needed, thereby further reducing production costs.

In addition, in the second drive gear train, the idler gears 9Y, 9C, and 9M are coaxially attached to the respective photoconductive gears 4Y, 4C, and 4M such that a part of each of the relay gears 14, 15, and 16 overlaps the gear parts 4aY, 4aC, and 4aM, respectively, thereby making the second drive transmission device 1YCM more compact. As a result, the image forming apparatus 100 can be made more compact.

As described above, the second drive transmission device 1YCM includes two separate drive sources, that is, the first drive motor 2*a* that supplies the driving force to the photoconductors 24Y, 24C, and 24M, and the second drive motor 2*b* that supplies the driving force to the developing rollers 81Y, 81C, and 81M. Accordingly, transmission of the driving force to the photoconductors 24Y, 24C, and 24M is completely separated from transmission of the driving force to the developing rollers 81Y, 81C, and 81M. As a result, a load on the developing rollers 81Y, 81C, and 81M does not affect rotation of the photoconductors 24Y, 24C, and 24M, respectively, thereby preventing variation in rotary speed of each of the photoconductors 24Y, 24C, and 24M.

The second drive gear train is accommodated within a length of the photoconductor gears 4Y, 4C, and 4M in a direction of the rotary shafts of the photoconductor gears 4Y, 4C, and 4M to reduce a length of the second drive transmission device 1YCM in that direction. In addition, the second drive gear train is provided at a position closer to the process units 26Y, 26C, and 26M than the gear parts 4aY, 4aC, and 4aM of the photoconductor gears 4Y, 4C, and 4M. Accordingly, each of the gear parts 4aY, 4aC, and 4aM can have a larger diameter without being obstructed by couplings 10bY, 10bC, and 10bM of the developing gears 10Y, 10C, and 10M. As a result, the diameter of each of the gear parts 4aY, 4aC, and 4aM can be expanded, such that a part of each of the gear parts 4aY, 4aC, and 4aM overlap the rotary shafts 81aY, 81aC, and 81aM of the developing rollers 81Y, 81C, and 81M, respectively. The larger diameter of each of the gear parts 4aY, 4aC, and 4aM can reduce a pitch error on the surfaces of the photoconductors 24Y, 24C, and 24M corresponding to engagement of teeth of the gear parts 4aY, 4aC, and 4aM and those of the first or second motor gear 3*a* or 3*b* one by one, thereby preventing uneven print density or banding in the sub-scanning direction.

Although transmitted to the photoconductors 24 and the developing rollers 81 in the process units 26 according to the foregoing illustrative embodiments; alternatively, the driving force may be transmitted to chargers 25Y, 25C, 25M, and 25K (hereinafter collectively referred to as chargers 25) or toner supply rollers 80Y, 80C, 80M, and 80K (hereinafter collectively referred to as toner supply rollers 80) in place of the developing rollers 81. Further alternatively, the driving force transmitted to the developing rollers 81 may be further transmitted to the chargers 25 or the toner supply rollers 80.

As described above, the idler gears 9Y, 9C, 9M, and 9K (hereinafter collectively referred to as idler gears 9) are coaxially attached to the photoconductor gears 4Y, 4C, 4M, and 4K (hereinafter collectively referred to as photoconductor gears 4) via the holding members 11Y, 11C, 11M, and 11K (hereinafter collectively referred to as holding members 11) in the foregoing illustrative embodiments. Alternatively, the idlers gears 9 may be directly attached to the shafts of the photoconductor gears 4. However, in a configuration in which the idler gears 9 are rotated in a direction opposite a direction of rotation of the photoconductor gears 4 as described in the foregoing illustrative embodiments, direct attachment of the idler gears 9 to the photoconductor gears 4 increases relative speed, possibly accelerating abrasion of the idler gears 9 and the photoconductor gears 4. Therefore, it is preferable that the idler gears 9 be coaxially attached to the photoconductor gears 4 via the holding members 11 in such a configuration in order to prevent abrasion of the idler gears 9 and the photoconductor gears 4.

By contrast, because the relative speed is reduced in a configuration in which the idler gears 9 and the photoconductor gears 4 are rotated in the same direction, it is preferable that the idler gears 9 be directly attached to the photoconductor gears 4 in this configuration in order to prevent abrasion of the idler gears 9 and the photoconductor gears 4. Further, when the idler gears 9 are attached to the photoconductor gears 4 via the holding members 11, respectively, vibration of the idler gears 9 is not directly transmitted to the photoconductor gears 4, thereby preventing variation in rotary speed of the photoconductors 24. By contrast, direct attachment of the idler gears 9 to the shafts of the photoconductor gears 4 can reduce number of components, thereby making the image forming apparatus 100 more compact.

In a case in which the idler gears 9 and the photoconductor gears 4 are rotated in the same direction at the same rotary speed, the idler gears 9 may be fixed to the photoconductor gears 4.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

What is claimed is:

1. A drive transmission device, comprising:

at least one drive source configured to provide a driving force;

a drive transmission member having an engaging part that engages a first rotary body provided within a unit detachably attachable to an image forming apparatus and a gear part operably engageable with a motor gear attached to the at least one drive source;

a drive gear train that transmits the driving force from the at least one drive source to a second rotary body provided within the unit, the drive gear train having a first gear and a second gear, the first gear engaging the motor gear, the second gear attached to the drive transmission member; and a stationary holding member that holds the drive transmission member and does not transmit the driving force transmitted to the drive transmission member or the drive gear train, wherein both the second gear and the drive transmission member are held by the holding member and individually transmit the driving force, and the holding member has a cylinder and holds a part of the drive transmission member on an inner circumferential surface of the cylinder and the second gear on an outer circumferential surface of the cylinder.

2. The drive transmission device according to claim 1, wherein the drive gear train is disposed closer to the unit than the gear part of the drive transmission member.

3. The drive transmission device according to claim 1, wherein the drive gear train is disposed within an axial' direction range of the drive transmission member.

4. The drive transmission device according to claim 1, wherein the second gear is rotatably and directly attached to the drive transmission member.

5. The drive transmission device according to claim 1, wherein the second gear is coaxially attached to the drive transmission member.

6. The drive transmission device according to claim 1, wherein the at least one drive source includes a first drive source that supplies the driving force to the drive gear train separately from a second drive source that supplies the driving force to the drive transmission member.

7. The drive transmission device according to claim 1, wherein the engaging part of the drive transmission member has a convexity that engages a concavity formed on the first rotary body.

8. The drive transmission device according to claim 1, wherein the engaging part and the gear part are provided coaxially with each other.

9. The drive transmission device according to claim 1, wherein the drive transmission member further comprises axial couplings configured to removably couple the drive transmission device and the unit including the first and second rotary bodies.

10. The drive transmission device according to claim 1, wherein the drive transmission member is fixed between a lateral plate and a support plate of the image forming apparatus and the unit operably engages the drive transmission device via at least one coupling that extends through the support plate.

11. The drive transmission device according to claim 1, wherein the engaging part, the gear part and the second gear are separately rotatable.

12. An image forming apparatus, comprising:

a unit having first and second rotary bodies and detachably attachable to the image forming apparatus; and a drive transmission device that transmits a driving force from at least one drive source to the first and second rotary bodies, the drive transmission device comprising: the at least one drive source;

a drive transmission member having an engaging part that engages the first rotary body and a gear part operably engageable with a motor gear attached to the at least one drive source;

a drive gear train that transmits the driving force from the at least one drive source to the second rotary body, the drive gear train having a first gear and a second gear, the first gear engaging the motor gear, the second gear attached to the drive transmission member; and a stationary holding member that holds the drive transmission member and does not transmit the driving force transmitted to the drive transmission member or the drive gear train, wherein both the second gear and the drive transmission member are held by the holding member and individually transmit the driving force, and the holding member has a cylinder and holds a part of the drive transmission member on an inner circumferential surface of the cylinder and the second gear on an outer circumferential surface of the cylinder.

13. The image forming apparatus according to claim 10, wherein the first rotary body to which the drive transmission member transmits the driving force is a latent image carrier.

14. The image forming apparatus according to claim 10, wherein the drive transmission member is provided to a housing of the image forming apparatus.

15. The image forming apparatus according to claim 10, wherein the engaging part and the gear part are provided coaxially with each other.

16. The image forming apparatus according to claim 12, further comprising a lateral plate and a support plate and the unit operably engages the drive transmission member via at least one coupling that extends through the support plate.

* * * * *